United States Patent [19]

Nozaki et al.

[11] 4,411,540

[45] Oct. 25, 1983

[54] PRINTING APPARATUS

[75] Inventors: Mineo Nozaki, Kawasaki; Masasumi Nagashima, Yokosuka; Osamu Asakura, Tokyo, all of Japan

[73] Assignee: Canon Kabushiki Kaisha, Tokyo, Japan

[21] Appl. No.: 293,878

[22] Filed: Aug. 18, 1981

[30] Foreign Application Priority Data

Aug. 27, 1980 [JP] Japan ..... 55/116997
Aug. 27, 1980 [JP] Japan ..... 55/116998

[51] Int. Cl.[3] ..... B41J 3/12

[52] U.S. Cl. ..... 400/175; 400/54; 400/120; 400/712

[58] Field of Search ..... 400/54, 703, 82, 175, 400/171, 120, 149, 150, 712

[56] References Cited

U.S. PATENT DOCUMENTS 4,184,781 1/1980 Ota ..... 400/54 X
4,281,938 8/1981 Phillips ..... 400/171

*Primary Examiner*—Paul T. Sewell
*Attorney, Agent, or Firm*—Fitzpatrick, Cella, Harper & Scinto

[57] ABSTRACT

A printing apparatus for serial printing by displacement of a printing head, in which a discriminating circuit identifies the typefont of the printing head mounted on the carriage, and a coincidence circuit compares the result of typefont identification with the typefont to be printed and provides alarm if the two are different.

6 Claims, 5 Drawing Figures

FIG. 5

| RAM | | |
|---|---|---|
| ADDRESS | CONTENTS | SORTS OF CHARACTER |
| 0 0 0 1 | ESTIMATED AMOUNT | 10 POINT |
| 2 | | |
| 3 | | |
| 4 | | |
| 5 | | |
| 6 | 1.1 BILLIONS | 12 POINT |
| 7 | | |
| 8 | | |
| 9 | | |
| 0 0 1 0 | | |
| 1 | | |
| 2 | DELIVERY DATE | 10 POINT |
| 3 | | |
| 4 | | |
| 5 | | |

PRINTING APPARATUS

BACKGROUND OF THE INVENTION

1. Field of the Invention

The present invention relates to a printing apparatus, and more particularly to a printing apparatus with several interchangeable printing heads for obtaining desired typefont.

2. Description of the Prior Art

In the printing apparatus, for example serial thermal printers, the displacement of the carriage having a thermal printing head has generally been achieved by a stepping motor because of simplicity in drive circuit and ease in control for performing reciprocating motion. However such a drive system has been associated with a drawback that the moving pitch of the carriage has to be constant because of the constant rotating angle of the stepping motor, eliminating the possibility of employing plural typefonts different in size and shape for the characters.

In order to avoid said drawback, the present applicant has disclosed, in its Japanese patent application No. 116845/1980, a printing apparatus capable of automatically regulating the printing pitch according to the typefont of the printing head. In said printing apparatus, however, the user has not necessarily been assuring whether the printing is achieved with the desired typefont.

SUMMARY OF THE INVENTION

The object of the present invention is to provide a printing apparatus capable of assuring the printing with the characters of a desired typefont.

Another object of the present invention is to provide a printing apparatus capable of prohibiting the printing operation with a typefont other than the character information stored in a memory.

BRIEF DESCRIPTION OF THE DRAWINGS

FIGS. 1 and 2 illustrate a first embodiment of the present invention wherein FIG. 1 is a schematic block diagram of the apparatus;

FIG. 2 is a schematic view of the thermal head discriminating device;

FIGS. 3 to 5 illustrate a second embodiment of the present invention wherein FIG. 3 is a schematic block diagram of the apparatus;

FIG. 4 is a schematic view of the thermal head discriminating device; and

FIG. 5 is a schematic view of the memory content.

DETAILED DESCRIPTION OF THE PREFERRED EMBODIMENTS

Figure 1:
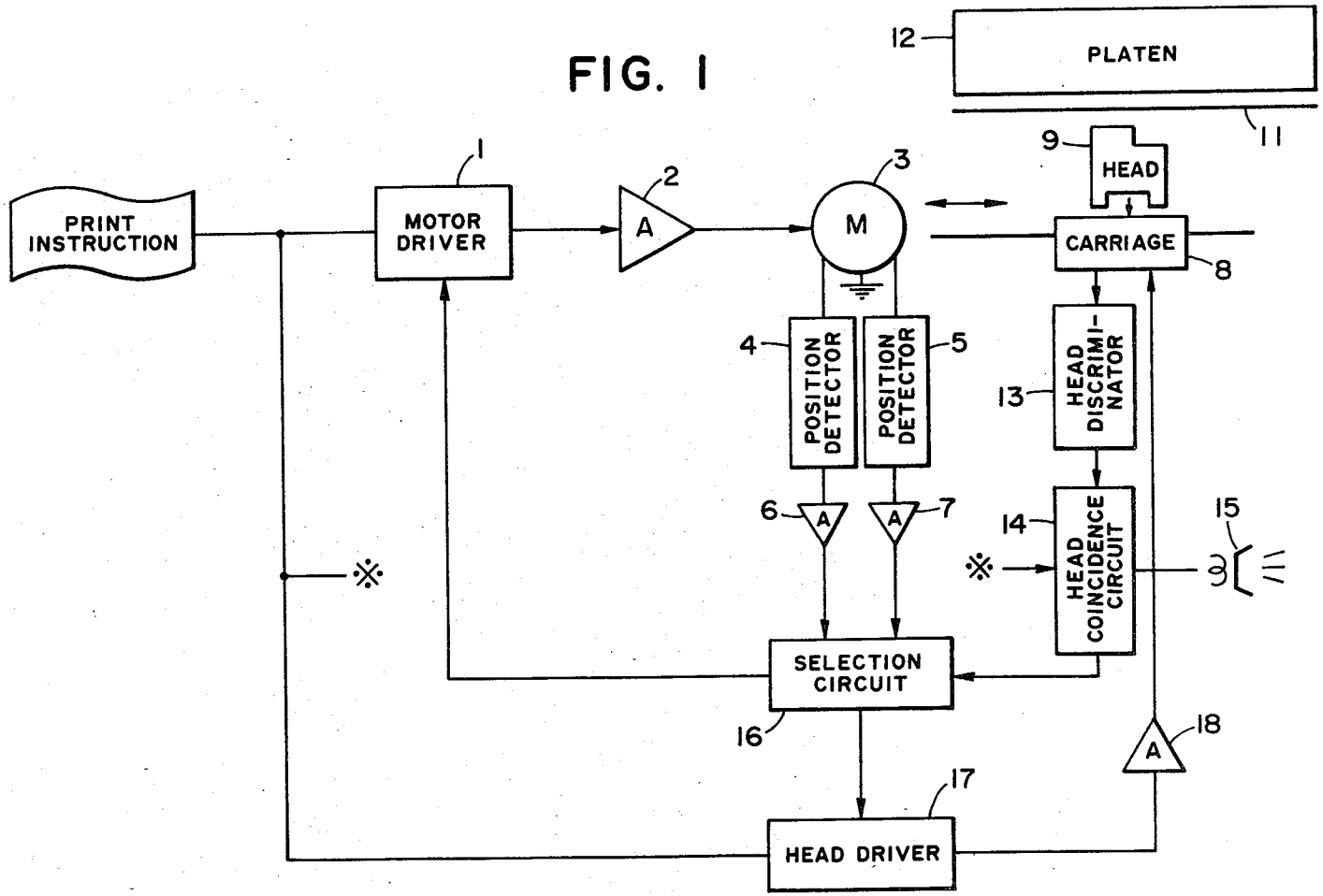

FIG. 1 is a schematic block diagram showing an embodiment of the present invention, wherein a servo motor drive circuit 1 drives a servo motor 3 through an amplifier 2. Said servo motor 3 is provided with position detectors 4, 5 of which output signals are amplified by amplifiers 6, 7. Thus, along with the rotation of the servo motor 3, two position detectors 4, 5 composed of slits or optical elements generate pulse signals of different timings.

Said servo motor 3 is mechanically linked, through unrepresented gears or wires, to a carriage 8 having a thermal printing head 9 composed of a column of plural heat-generating elements, which performs reciprocating motion in the printing direction along with the rotation of the servo motor 3.

Figure 2:
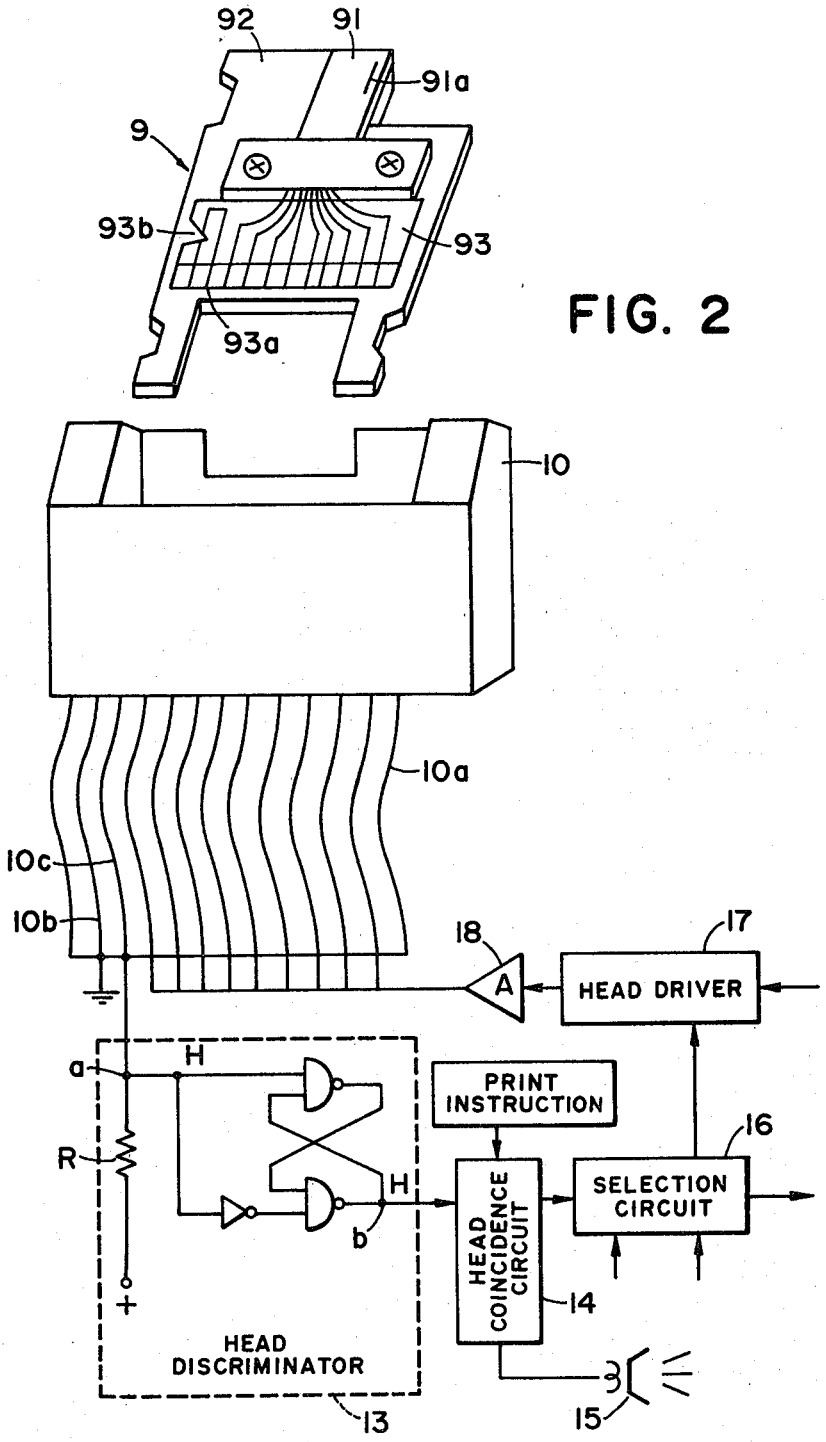

On the carriage 8 there is provided a connector 10 as shown in FIG. 2 for supporting and electrically connecting the thermal head 9 in interchangeable manner. Facing the heat-generating elements of the thermal head 9 there are provided a recording paper 11 and a platen 12, to which the thermal head 9 is continuously maintained in contact during the printing operation.

Again referring to FIG. 1, a head discriminating circuit 13 is connected to said connector 10 for identifying the thermal head 9 mounted thereon.

Also a head coincidence circuit 14 identifies if the head identified by the head discriminating circuit 13 coincides with the printing head of the typefont designated by the printing instruction. The printing instruction includes the print start information for instructing the start of a series of printing operation and the typefont information instructing the typefont of the characters to be printed, and the head coincidence circuit 14 utilizes said typefont information. A loudspeaker 15 is provided for giving alarm.

A selection circuit 16 selects the timing pulses either from the position detector 4 or 5 according to the output signal from said head coincidence circuit 14, and the timing pulses thus selected are supplied to the motor drive circuit 1 controlled by the print instruction thereby compensating the motor speed to a designated speed.

The motor drive circuit 1 is instructed of the start timing of motor drive by the print start information of the print instruction, and of the motor rotating speed by the typefont information.

The timing pulse selected by the selection circuit 16 is further supplied to a head drive circuit 17 to instruct the timing of energization of the thermal head. Thus, in response to the entry of a timing pulse, the head drive circuit 17 is activated from the stand-by state realized by the print start information of the print instruction thereby driving the thermal head 9 through an amplifier 18 during a period and at a voltage determined by the typefont information of the print instruction.

FIG. 2 shows the arrangement of a device for discriminating the thermal head 9, which is composed of a graze portion 91, a printed circuit board 93 for supplying current to heating elements 19*a* and a head sink 92 to which said graze portion 91 and circuit board 93 are fixed with screws. The circuit patterns on said circuit board 93 include U-shaped patterns 93*a*, 93*b* which are independent from the circuits leading to the heating elements and which may be partially cut in the part of 93*b* to represent different resistances according to the typefonts of the thermal heads.

There printed circuit board 93 of the thermal head 9 is connected through the connector 10 to a flexible cable 10*a*, of which a lead 10*b* connected to said pattern 93*b* is grounded while a lead 10*c* connected to said pattern 93*a* is connected to an input terminal a of the head discriminating circuit 13. Said circuit 13 is composed of a latch circuit having a same level at the input terminal a and at the output terminal b, and also functions to prevent erroneous operation of the printer resulting from the noise generated at the mounting of the thermal head 9.

The above-explained embodiment functions in the following manner.

Upon insertion of a thermal head 9 into the connector 10 on the carriage 8, the input terminal a of the head discriminating circuit 13 connected to the power supply through a resistor R changes the voltage level according to the specification of the thermal head. As explained in the foregoing, the pattern 93*a* of the printed circuit board 93 of the thermal head 9 is connected to said input terminal a of the head discriminating circuit 13 through the connector 10, while the lead 10*b* is grounded. Thus upon insertion of the thermal head corresponding for example to a character size of 12 points in which the pattern 93*b* is cut, the head discriminating circuit 13 receives a high-level input voltage at the terminal a to provide likewise a high-level output voltage at the terminal b.

Similarly upon insertion of a thermal head corresponding to a character size of 10 points in which the pattern 93*b* is not cut, the head discriminating circuit 13 receives a low-level input at the terminal a to provide a low-level output at the terminal b. In response to such automatic identification of the thermal head 9 at the head discriminating circuit 13, the head coincidence circuit 14 compares the result of said identification with the typefont information of the print instruction and activates an alarm, i.e. loudspeaker 15 in case a different thermal head 9 is mounted, thus advising the operator to exchange the thermal head. The motor 3 is stopped in this state. On the other hand, in case a correct thermal head is mounted, the selection circuit 16, in response to the output signal from the head coincidence circuit 14, selects the position detector 4 or 5 for position detection for energizing the thermal head 9. Also the servo motor 3 is rotated by the motor drive circuit through the amplifier 2 according to a speed designated by the typefont information of the print instruction.

The carriage 8 is set into motion in this manner, and, in response to the position detection timing transmitted from the selection circuit 16, the head drive circuit 17 which has been in stand-by state by the print start information of the print instruction, energizes the heating elements 91*a* at determined positions of the printing paper 11 through the amplifier 18, connector 10 and printed circut board 93 for a period determined by the typefont information of the print instruction, thereby achieving thermal printing.

In this manner it is rendered possible to modify the displacing speed of the carriage 8, the energizing timing and period to the recording paper 11 according to the species of the thermal head 9, thus ensuring appropriate printing.

Figure 3:
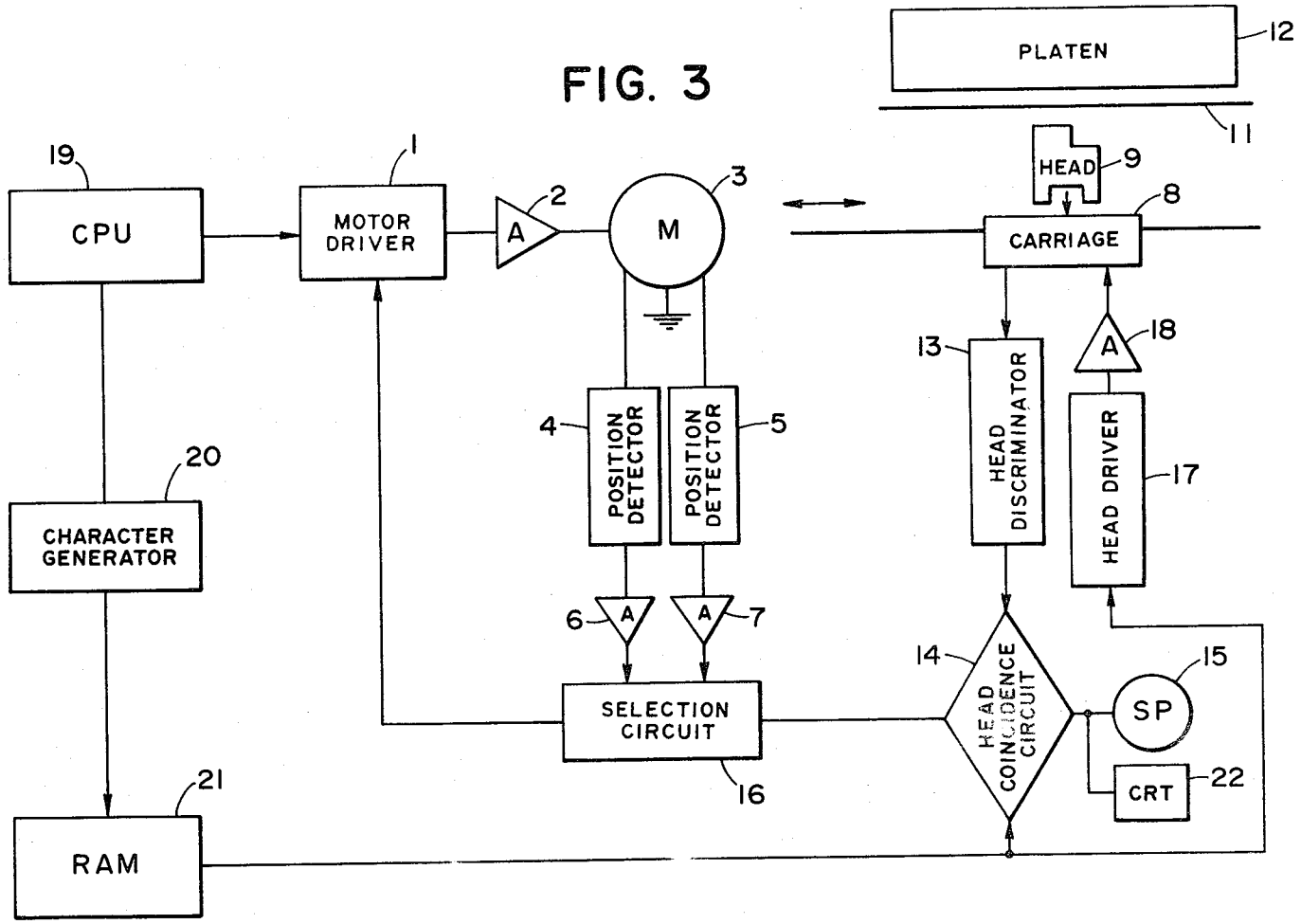
Figure 4:
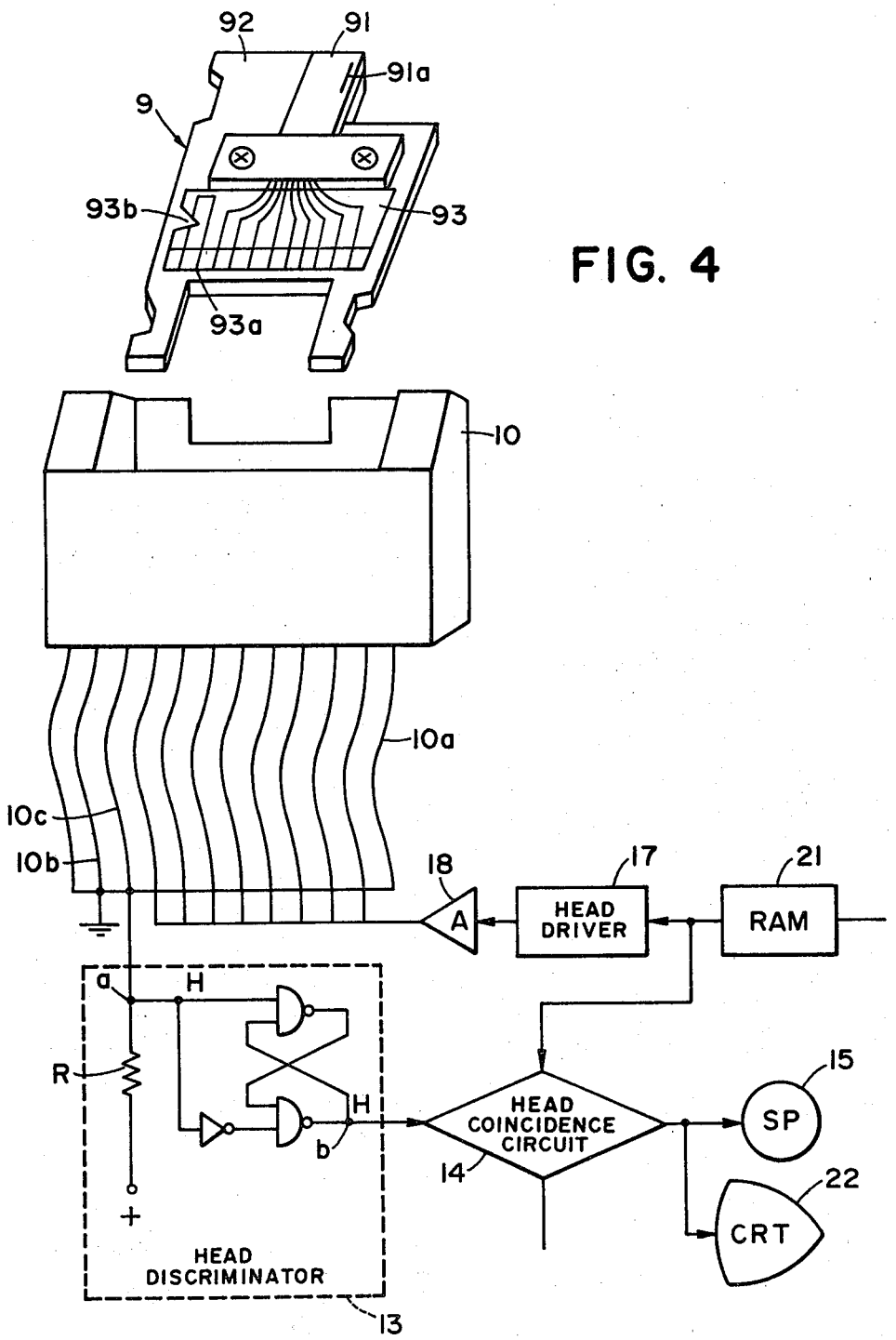

Now FIGS. 3 to 5 illustrate a second embodiment of the present invention, in which the result of identification by the head discriminating circuit is compared with a memory content storing the character to be printed, and, if the two are different, an instruction for head change is issued and the printing pitch is regulated according to the changed head.

In FIGS. 3 and 4, a central processing unit (CPU) 19 releases an instruction to a character generator (CG) 20 to form a typefont of characters and symbols, and said character generator 20 releases character signals of one line to a random access memory (RAM) 21 for storage therein. The output signal from said RAM 21 and that from a head discriminating circuit 13 are compared in a head coincidence circuit 14, and, if the typefont to be printed is different from the data stored in the RAM 21, an alarm means such as a loudspeaker 15 is activated and the printing head to be mounted is displayed on a display unit 22. On the other hand, in case the head coincidence circuit 14 provides a coincidence output signal, a selection circuit 16 selects a position detector of which timing signal is supplied to a motor drive circuit 1 and a head drive circuit 17. The energizing period and voltage of said head drive circuit to the thermal head 9 are designated by typefont information stored in the RAM 21. Also the rotating speed of the motor 3, controlled by the motor drive circuit 1, is determined by the typefont information stored in the RAM 21 supplied to said circuit 1 through the CPU 19.

FIG. 5 shows the content of memory in the RAM 11, in which each address contains a character obtained by the character generator 20 (for example a "Kanji" or phonetic character at the address "0001") and information indicating the species of character (for example a character of 10 points at the address "0001"). Upon completion of printing of one line, the RAM is reset and stores the information for the next line.

The above-explained second embodiment functions in the following manner.

Upon receipt of a print instruction, the CPU 19 rotates the servo motor 3 through the motor drive circuit 1 and the amplifier 2, thereby displacing the mechanically linked carriage 8 and thermal head 9 in the printing direction. At the same time, the thermal head 9 for 10-point characters is identified by the head discriminating circuit 13 and compared with the typefont information stored in the RAM 21 by the head coincidence circuit 14, which releases a coincidence output signal if the two coincide with each other. As explained in the foregoing, the thermal head for 10-point characters has the intact pattern 93*b*, whereby the head discriminating circuit 13 provides a low-level output signal. In response to said coincidence signal, the selection circuit 16 selects the position detector 4 for 10-point characters, of which output pulses are supplied to the motor drive circuit 1 and the head drive circuit 17 to serially print characters "ESTIMATED AMOUNT" in 10-point characters corresponding to the addresses 0001 to 0005. In this state, the rotating speed of the motor 3 controlled by the motor drive circuit 1 and the energizing period and voltage of thermal head 9 controlled by the head drive circuit 17 are designated by the typefont information stored in the RAM 21.

After serial printing with 10-point characters in this manner, the carriage 8 and the thermal head 9 reaches a position for character printing corresponding to the address 0006 with 12-point character. However, as the connector 10 currently holds a thermal head for 10-point characters, the head coincidence circuit identifies the difference and releases an alarm through the loudspeaker 15, simultaneously with a display "Change head to 12 points" on the display unit 22. At the same time the non-coincidence output signal from the head coincidence circuit 14 cuts off the motor drive circuit 1 to stop the servo motor 3.

In this manner the printing with 10-point characters is interrupted and the head replacement is requested to the operator. Upon replacement of the 10-point head by the 12-point head according to said request, the head discriminating circuit 13 changes the output level at the terminal b. The 12-point thermal head 9 has a cut pattern 93*b* on the printed circuit board 93 to provide a high-level voltage at the input terminal a thereby giving a high-level output at the terminal b.

In this manner the 12-point thermal head 9 is identified by the head discriminating circuit 13 and compared with the data stored in the RAM 21 by the head coincidence circuit 14, which thus terminates the alarm through the loudspeaker 15 and the display on the display unit 22 and restarts the rotation of the servo motor 3 at a speed corresponding to the 12-point character printing, thus initiating the printing with 12-point characters from the address 0006 of RAM 21 by the displacement of the carriage 8 and thermal head 9. In this state, in response to the output signal from the head coincidence circuit 14, the selection circuit 16 selects the timing pulses from the position detector 5 for 12-point characters. Also the rotating speed of the motor 3 controlled by the motor drive circuit 1 and the energizing period and voltage to the thermal head controlled by the head drive circuit 17 are newly designated by the typefont information for 12-point characters stored in the RAM 21. In this manner the printing with 12-point characters is continued from the address 0006 to 0011.

At the address 0012 from which the characters are again changed to 10 points, the carriage 8 stops in the aforementioned manner, and a request is given for head replacement. The printing thereafter proceeds in a similar manner with intermediate head replacements.

In the foregoing embodiment, the carriage is stopped at each position of typefont change, but it is also possible to return the carriage to the start position at each typefont change, to displace the carriage to the interrupted printing position after replacement of the thermal head and to continue the printing. It is furthermore possible to print all the 10-point characters in a line at first, then to replace the thermal head without paper advancement and to conduct carriage scanning again for printing 12-point characters. As explained in the foregoing, the second embodiment ensures printing with desired typefonts without error even when different fonts are mixed in a line, owing to the comparison of the output signal from the head discriminating circuit 13 with the data stored in the RAM 21.

Although the foregoing description has been limited to a one-column type thermal head, the present invention is by no means limited to such embodiment but covers other printing heads such as a 5×7 dot-matrix thermal head, a wire-dot printing head or a printing head with conventional typefont. In addition the present invention is not limited to interchanging of two different printing heads but also covers interchanging of three or more printing heads, and the discriminating method for heads can also be modified in various manners.

What we claim is:

1. A printing apparatus comprising:

a printing head detachably mounted on a carriage;

discriminating means for identifying a typefont of said printing head mounted on said carriage;

coincidence detecting means for comparing a result of identification by said discriminating means with the typefont information of characters to be printed;

alarm means for giving an alarm in response to a non-coincidence output signal from said coincidence detecting means; and selection means adapted for selecting either one of plural position detecting means for detecting carriage position in response to a coincidence output signal from said coincidence detecting means.

2. A printing apparatus according to claim 1, wherein said alarm means is an acoustic signal generator.

3. A printing apparatus according to claim 1, further comprising motor drive means adapted for driving a motor for driving said carriage and for terminating said motor drive in response to the non-coincidence output signal from said coincidence detecting means.

4. A printing apparatus according to claim 1, further comprising memory means for storing typefont information of characters to be printed and to be compared by said coincidence detecting means and character information corresponding thereto.

5. A printing apparatus according to claim 1, further comprising head drive means in which energizing period and energizing voltage of said printing head each is designated in response to the typefont information of the characters to be printed.

6. A printing apparatus according to claim 1, wherein said alarm means is a display device.

* * * * *